US012680403B2

(12) United States Patent
Solyom et al.

(10) Patent No.: US 12,680,403 B2
(45) Date of Patent: Jul. 14, 2026

(54) RELEASABLE ANCHOR

(71) Applicant: Tier 1 Energy Solutions, Inc., Edmonton (CA)

(72) Inventors: Attila Solyom, Edmonton (CA); Jeffrey Golinowski, Edmonton (CA); Daniel P. Lupien, Edmonton (CA)

( * ) Notice: Subject to any disclaimer, the term of this patent is extended or adjusted under 35 U.S.C. 154(b) by 0 days.

(21) Appl. No.: 18/612,546

(22) Filed: Mar. 21, 2024

(65) Prior Publication Data

US 2024/0318518 A1 Sep. 26, 2024

Related U.S. Application Data

(60) Provisional application No. 63/491,455, filed on Mar. 21, 2023.

(51) Int. Cl.

| | |
|---|---|
| ***E21B 23/01*** | (2006.01) |
| ***E21B 33/12*** | (2006.01) |
| ***E21B 43/08*** | (2006.01) |
| ***E21B 43/10*** | (2006.01) |

(52) U.S. Cl.

CPC ..... *E21B 23/01* (2013.01); *E21B 33/12* (2013.01); *E21B 43/08* (2013.01); *E21B 43/10* (2013.01)

(58) Field of Classification Search

CPC ..... E21B 23/01; E21B 33/12; E21B 43/08; E21B 43/10; E21B 23/06

See application file for complete search history.

(56) References Cited

U.S. PATENT DOCUMENTS 2,878,877 A * 3/1959 Baker ..... E21B 33/12955 166/212
3,391,742 A * 7/1968 Davis ..... E21B 33/1292 166/139
3,608,634 A * 9/1971 Cochran ..... E21B 23/06 166/212

(Continued)

FOREIGN PATENT DOCUMENTS

| | | |
|---|---|---|
| CA | 3205536 A1 | 1/2024 |
| CA | 3232449 | 6/2025 |
| CA | 3232815 | 6/2025 |

OTHER PUBLICATIONS

Steelhaus Technologies Inc., Commodity #921 Solace Liner Hanger—Tech Manual (Calgary, AB).

(Continued)

*Primary Examiner* — Steven A MacDonald
(74) *Attorney, Agent, or Firm* — Bennett Jones LLP

(57) ABSTRACT

The present disclosure relates to a releasable anchor, which may be used in a thermal wellbore, such as a SAGD wellbore. The anchor may be combined with a retrievable packer assembly that mechanically locks and seals into a profile sub. The packer assembly can convert to a bridge plug and be run in place with a liner to isolate the wellbore during the liner setting stage or it can be run into a pre-installed profile sub during a work-over stage in conjunction with a production/injection string to divert flow through a particular section of production liner string. The packer assembly may then be retrieved, and the hydraulic anchor released, allowing movement as a result of any thermal liner pipe expansion, while the thermal element on the liner top packer stays set and sealing within the parent casing.

2 Claims, 8 Drawing Sheets

(56) References Cited

U.S. PATENT DOCUMENTS

| | | | | | |
|---|---|---|---|---|---|
| 3,631,924 | A * | 1/1972 | McGill | E21B 33/1293 | 166/134 |
| 3,645,335 | A * | 2/1972 | Current | E21B 33/12 | 166/120 |
| 3,746,093 | A * | 7/1973 | Mullins | E21B 33/1293 | 166/134 |
| 3,749,166 | A * | 7/1973 | Young | E21B 23/06 | 166/134 |
| 4,044,826 | A * | 8/1977 | Crowe | E21B 23/06 | 166/182 |
| 4,216,827 | A * | 8/1980 | Crowe | E21B 33/1295 | 166/182 |
| 4,285,400 | A * | 8/1981 | Mullins | E21B 33/1295 | 166/120 |
| 4,423,782 | A * | 1/1984 | Bowyer | E21B 33/1294 | 166/321 |
| 4,438,811 | A * | 3/1984 | Patel | E21B 33/1293 | 166/134 |
| 4,754,814 | A * | 7/1988 | Jordan, Jr. | E21B 33/1295 | 166/134 |
| 4,862,957 | A * | 9/1989 | Scranton | E21B 33/1295 | 166/134 |
| 5,526,884 | A * | 6/1996 | Lembcke | E21B 23/01 | 166/120 |
| 10,760,363 | B2 * | 9/2020 | Tom | E21B 23/01 | |
| 10,920,510 | B2 * | 2/2021 | Egleton | E21B 23/0411 | |
| 11,802,454 | B2 * | 10/2023 | Egleton | E21B 23/04 | |
| 2004/0026092 | A1 | 2/2004 | Divis et al. | | |
| 2004/0216877 | A1 * | 11/2004 | Pedersen | E21B 43/10 | 166/387 |
| 2011/0284208 | A1 * | 11/2011 | MacLeod | E21B 41/00 | 166/88.2 |
| 2012/0132438 | A1 * | 5/2012 | Telfer | E21B 23/06 | 166/321 |
| 2013/0299160 | A1 * | 11/2013 | Lott | E21B 23/01 | 166/88.2 |
| 2015/0292284 | A1 * | 10/2015 | Lemm | E21B 33/1291 | 166/216 |
| 2016/0115762 | A1 * | 4/2016 | O'Dwyer | E21B 33/12 | 166/134 |
| 2016/0273287 | A1 * | 9/2016 | Scott | E21B 23/00 | |
| 2017/0234090 | A1 * | 8/2017 | Egleton | E21B 23/04 | |
| 2021/0079745 | A1 * | 3/2021 | Egleton | E21B 23/04 | |
| 2023/0287747 | A9 * | 9/2023 | Egleton | E21B 23/04 | |
| 2024/0318520 | A1 | 9/2024 | Solyom et al. | | |

OTHER PUBLICATIONS

Steelhaus Technologies Inc. 921 Solace Liner Hanger Packer—Product Information (Calgary, AB).

United States Patent and Trademark Office, Office Action Summary, Jan. 15, 2025 (Alexandria, Virginia).

* cited by examiner

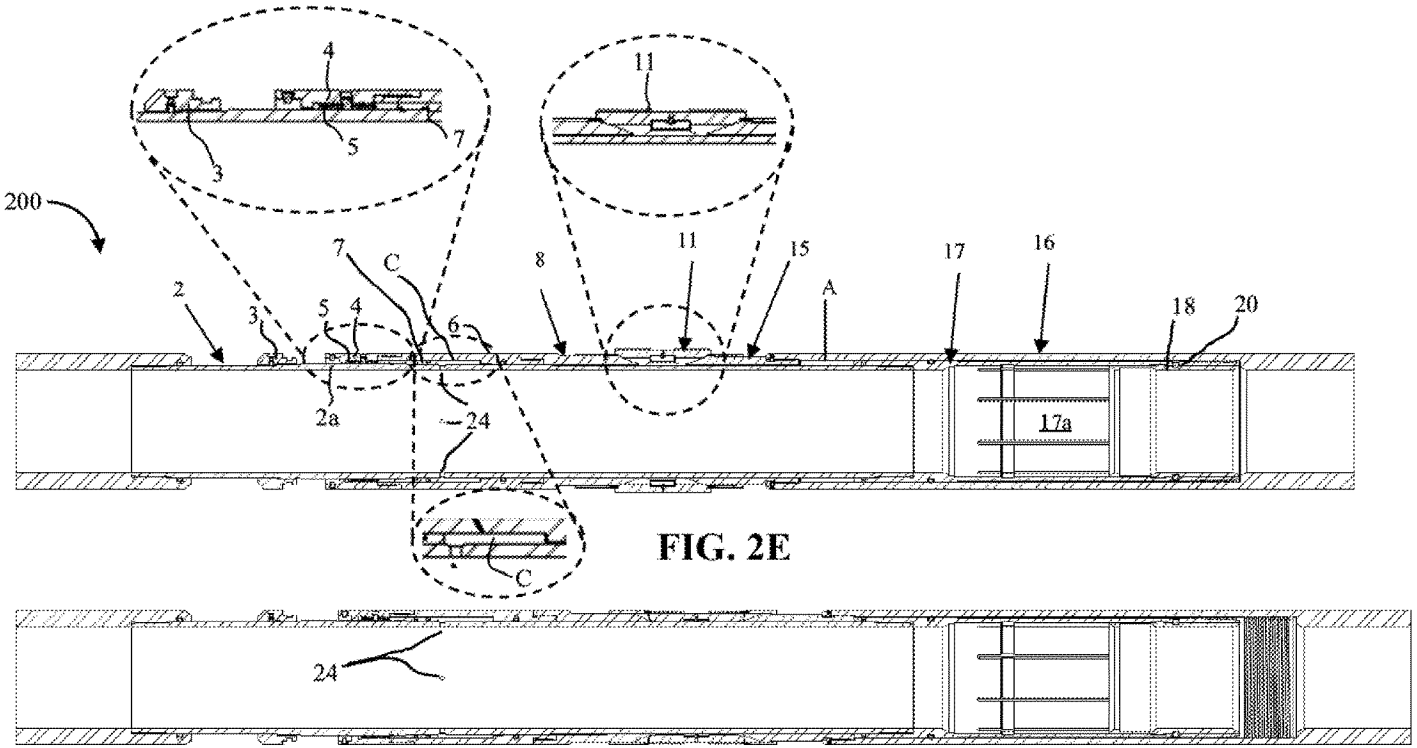
FIG. 2E
FIG. 2F
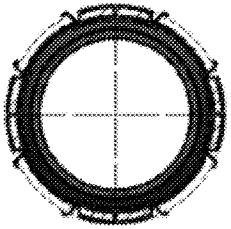
FIG. 2G

RELEASABLE ANCHOR

FIELD OF THE INVENTION

The present invention generally relates to a releasable anchor, particularly for use in thermal wellbores.

BACKGROUND

Thermal wellbores and SAGD (steam-assisted gravity drainage) wellbores conventionally include concentric casings, such as surface casing and intermediate casing. A slotted liner is installed at a lower end of the intermediate casing, and a casing liner is then installed, typically in a horizontal section of the wellbore. In the completion process, the casing liner is run into the hole through the intermediate casing and into the slotted liner, such that liner top overlaps with the lower end of the existing tubular. The liner is delivered using a running tool that ultimately releases from the liner once a liner hanger on the liner string is set against the existing tubular.

Such wellbores experience temperature cycling and as a result the liner pipe thermally expands and contracts. This pipe movement causes increase wear and eventual failure of the sealing element on the liner top packer.

SUMMARY OF THE INVENTION

The present disclosure relates to a releasable anchor, which may be used in a thermal wellbore, such as a SAGD wellbore. The anchor may be combined with a retrievable packer assembly that mechanically locks and seals into a profile sub. The packer assembly can convert to a bridge plug and be run in place with a liner to isolate the wellbore during the liner setting stage or it can be run into a pre-installed profile sub during a work-over stage in conjunction with a production/injection string to divert flow through a particular section of production liner string. The packer assembly may then be retrieved, and the hydraulic anchor released, allowing movement as a result of any thermal liner pipe expansion, while the thermal element on the liner top packer stays set and sealing within the parent casing.

In one aspect, disclosed is a releasable anchor comprising:

(a) a cylindrical mandrel defining an inner volume;

(b) a top sub attached to an upper end of the mandrel;

(c) an anchor ring fixed to an outer surface of the mandrel and an upper cone slidably moveable between a running position and an activated position, wherein activation elements are disposed between the anchor ring and the upper cone, defining a sealed activation chamber between the activation elements and the mandrel, which activation chamber is in fluid communication to the mandrel inner volume through at least one port, wherein expansion of the activation chamber causes the activation elements and the upper cone to move to their activated position;

(d) a lower cone fixed to the mandrel and a bottom housing fixed to a lower end of the lower cone by at least one shear pin;

(e) a slip assembly comprising slips actuatable between the upper cone and the lower cone;

(f) a collet adapter affixed to a lower end of the mandrel and disposed within the bottom housing, the collet adapter having downwardly extending collet fingers;

(g) a shift ring slidable slidably moveable within the collet adapter between a non-released position where the shift ring retains the collet fingers against an inner surface of the bottom housing, preventing longitudinal movement of the bottom housing relative to the mandrel, and a released position where the collet fingers may disengage the bottom housing, permitting longitudinal movement of the bottom housing relative to the mandrel.

In another aspect, disclosed is a method of installing a liner in a wellbore having a intermediate casing, with a completion assembly comprising a liner connected below a liner top packer and a releasable anchor as claimed in claim 1, wherein a profile packer assembly is positioned within the releasable anchor, comprising the steps of.

(a) positioning the liner top packer at a lower end of the intermediate casing;

(b) landing a ball in the profile packer assembly and pressuring up the wellbore to activate the releasable anchor to engage the intermediate casing and to activate the packer to seal against the intermediate casing;

(c) retrieving the profile packer assembly; and (d) releasing the releasable anchor with a shift tool, leaving the liner connected to the liner top packer in an energized, pressure-competent state isolating the wellbore below the liner top packer.

In some embodiments, the apparatus may comprise any combination of features or elements described below or shown in the drawings attached.

BRIEF DESCRIPTION OF THE FIGURES

The accompanying drawings, which are incorporated herein and form a part of the specification, illustrate some, but not the only or exclusive, examples of embodiments and/or features.

FIGS. 2E and 2F show the same view in FIG. 2A, in slip extended and released positions, respectively.

FIG. 2G shows a transverse cross section of the anchor with slips at maximum extension.

DETAILED DESCRIPTION

Figure 1A:
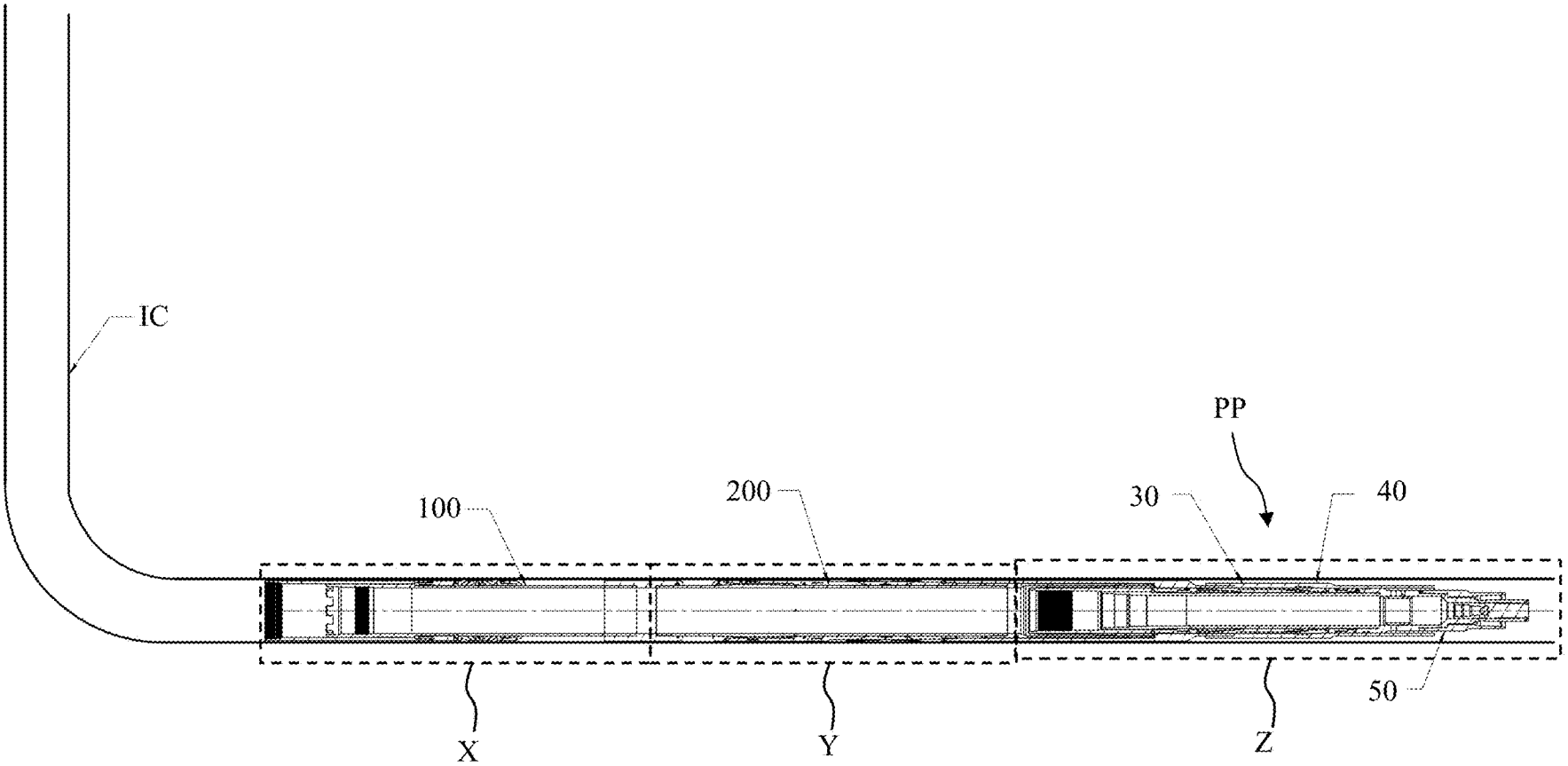
FIG. 1A shows an example of an installation of one embodiment of a thermal liner top packer, releasable anchor and profile packer set in casing in a thermal wellbore.
Figure 1B:
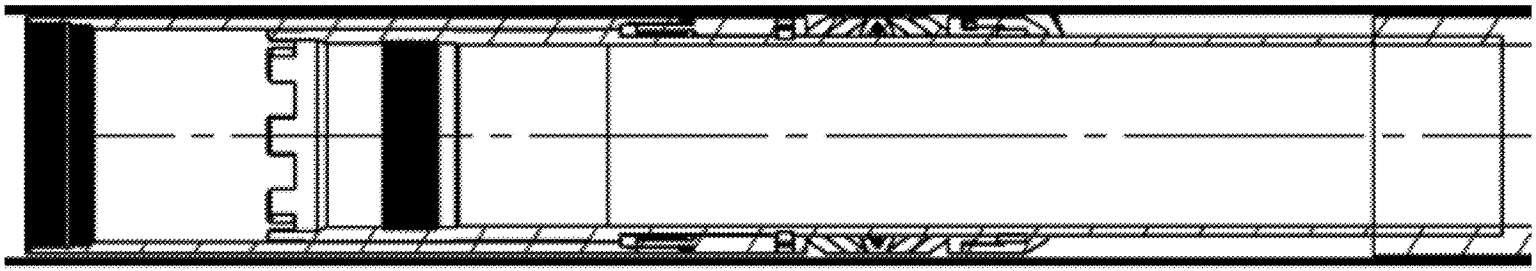
FIG. 1B shows an enlarged view of the portion labelled "X" in FIG. 1A.
Figure 1C:
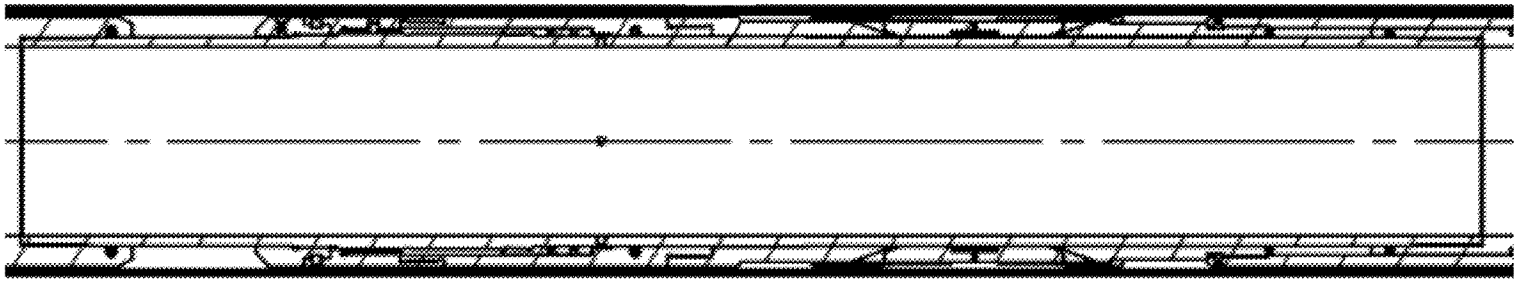
FIG. 1C shows an enlarged view of the portion labelled "Y" in FIG. 1A.
Figure 1D:
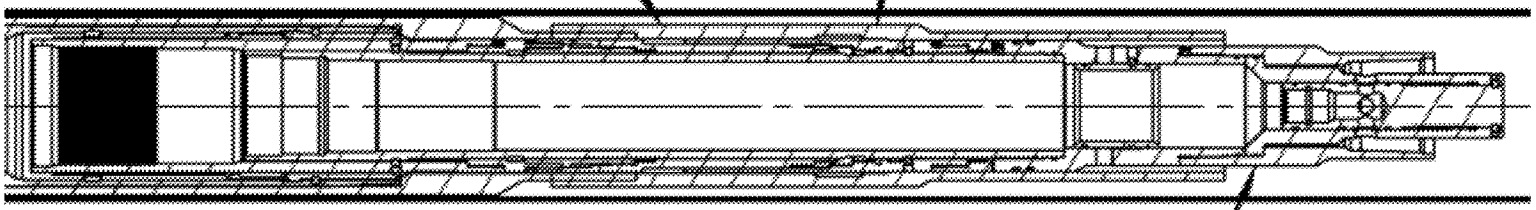
FIG. 1D shows an enlarged view of the portion labelled "Z" in FIG. 1A.
Figure 2A:
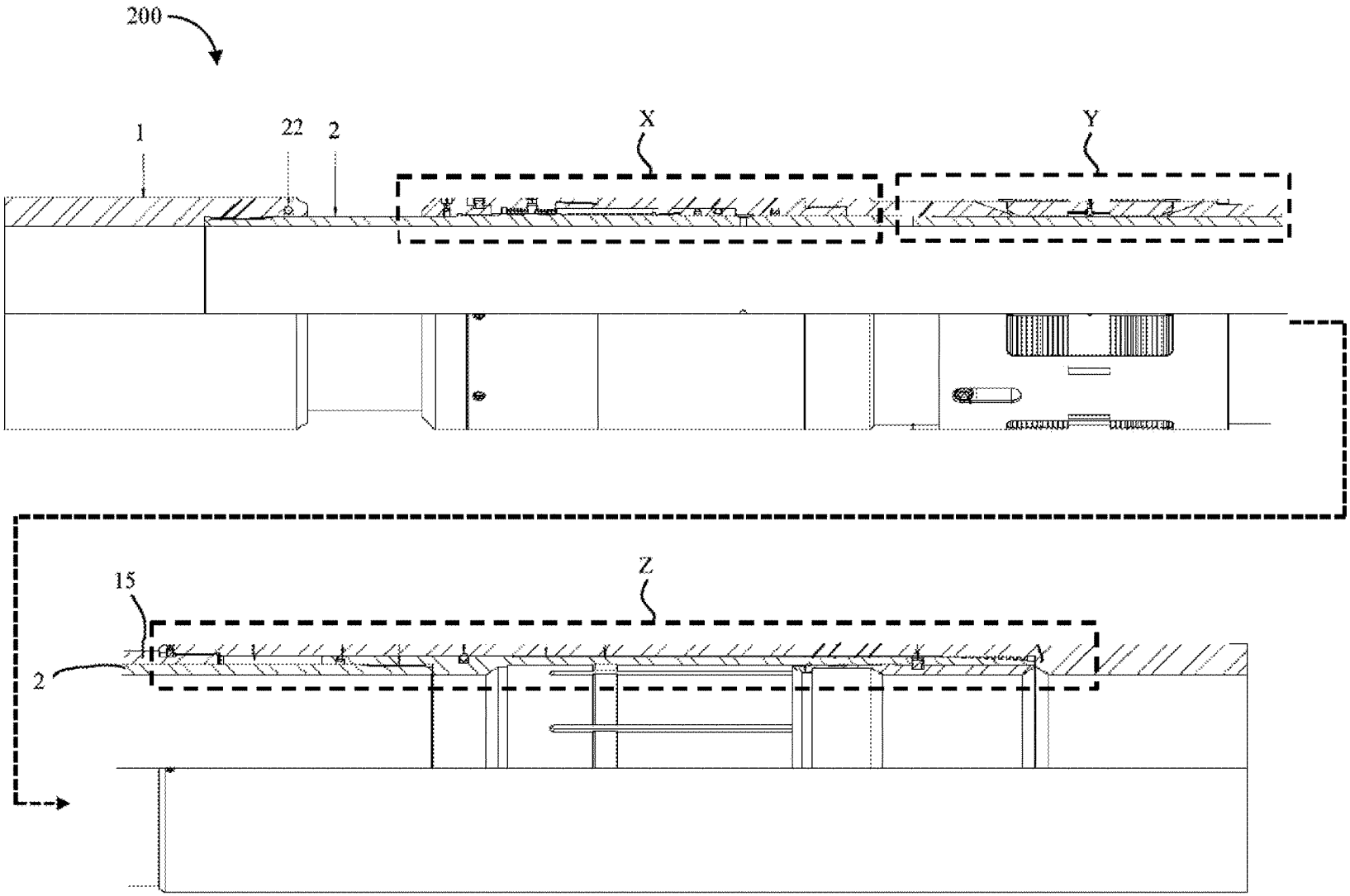
FIG. 2A is a cross-sectional view of the releasable anchor in run-in-hole (RIH) position.
Figure 2B:
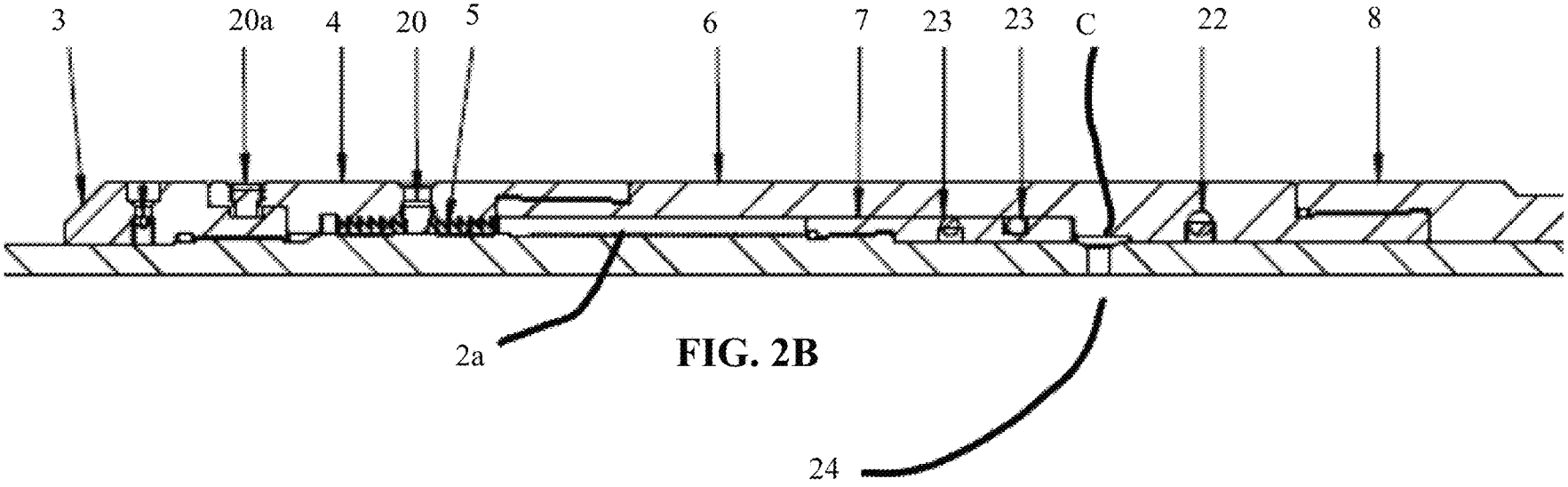
FIG. 2B shows an enlarged view of the portion labelled "X" in FIG. 2A.
Figure 2C:
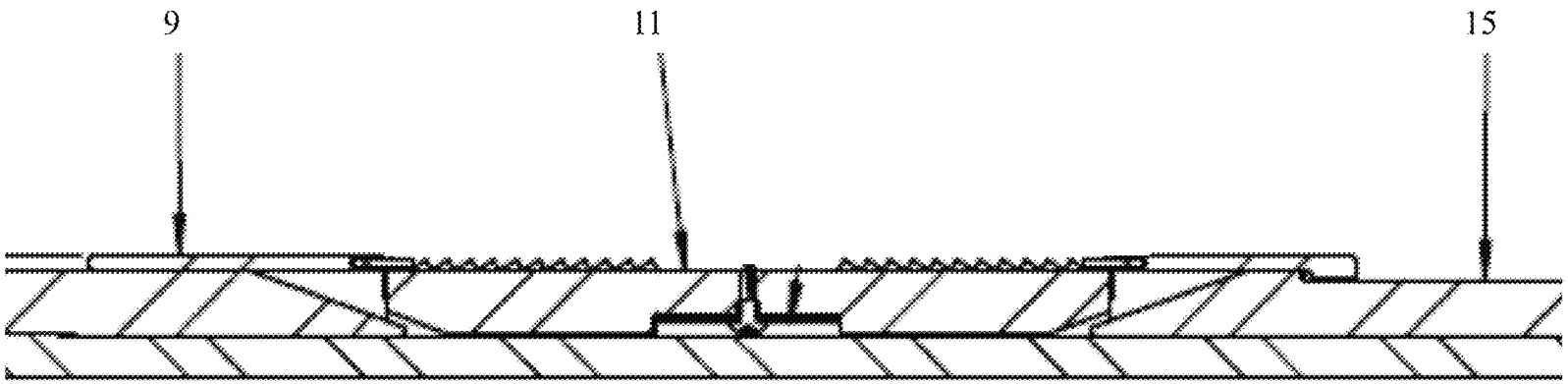
FIG. 2C shows an enlarged view of the portion labelled "Y" in FIG. 2A.
Figure 2D:
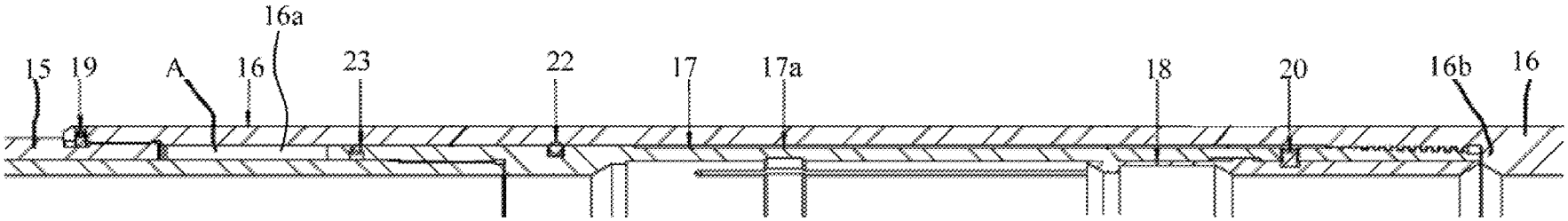
FIG. 2D shows an enlarged view of the portion labelled "Z" in FIG. 2A.

The present invention now will be described more fully hereinafter with reference to the accompanying drawings, in which some, but not all embodiments of the invention are exemplified. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation. Conventional components of the invention are elements that are well-known in the prior art and will not be discussed in detail for this disclosure.

As exemplified in FIGS. 1A-1D, an assembly is installed in intermediate casing (IC). The assembly comprises a thermal liner top packer 100, a releasable thermal anchor 200, and a profile packer assembly PP comprising a lock assembly 30, a profile sub 40 and a trip sub assembly 50. This operation may be intended to install a liner (not shown in FIGS. 1A-1D) into the wellbore.

In some embodiments, the profile packer (not shown) is an apparatus which mechanically locks and seals into the profile sub 40 with multiple functionality options. The profile packer can convert to a bridge plug and be run in place with a liner to isolate the wellbore during the liner setting stage or it can be run into the profile sub 40 during a work-over stage in conjunction with a production/injection string to divert flow through a particular section of production liner string. Whether in bridge plug mode or liner isolation packer mode, the profile packer is releasable using a conventional latch style retrieving tool.

In one embodiment, a releasable anchor 200 comprises:

(a) a cylindrical mandrel defining an inner volume;

(b) a top sub attached to an upper end of the mandrel;

(c) an anchor ring fixed to an outer surface of the mandrel and an upper cone slidably moveable between a running position and an activated position, wherein activation elements are disposed between the anchor ring and the upper cone, defining a sealed activation chamber between the activation elements and the mandrel, which activation chamber is in fluid communication to the mandrel inner volume through at least one port, wherein expansion of the activation chamber causes the activation elements and the upper cone to move to their activated position;

(d) a lower cone fixed to the mandrel and a bottom housing fixed to a lower end of the lower cone by at least one shear pin;

(e) a slip assembly comprising slips actuatable between the upper cone and the lower cone;

(f) a collet adapter affixed to a lower end of the mandrel and disposed within the bottom housing, the collet adapter having downwardly extending collet fingers;

(g) a shift ring slidable slidably moveable within the collet adapter between a non-released position where the shift ring retains the collet fingers against an inner surface of the bottom housing, preventing longitudinal movement of the bottom housing relative to the mandrel, and a released position where the collet fingers may disengage the bottom housing, permitting longitudinal movement of the bottom housing relative to the mandrel.

FIGS. 2A-2G shows a longitudinal cross-section of one embodiment of a releasable thermal anchor 200. FIGS. 2A-2D show the anchor 200 in its run-in-hole (RIH) configuration. A top sub 1 provides threaded connection to the liner top packer 100 above and sealed with O-ring 22 to a mandrel 2. The mandrel 2 is threaded to the top sub 1 at its top end, and at its lower end, connected to a lower collet adapter 17 having collet fingers 17*a*. A bottom housing 16 has a lower connection end 16*a* and defines a sealed chamber A between the bottom housing 16 and the mandrel 2. The bottom housing 16 defines a lower shoulder 16*b* against which a lower end of the collet fingers 17*a* abut. The inner surface of the bottom housing 16 and an outer surface of the collet fingers 17*a* define complementary threads which connect the two elements when in a non-released position, as shown in FIGS. 2A-2E. A shift ring 18 is disposed within the collet adapter 17 which maintains the collet fingers 17*a* in contact with the bottom housing 16, preventing longitudinal movement of the mandrel 2 relative to the bottom housing 16. The shift ring 18 defines an inner shift profile and longitudinal movement of the shift ring 18 relative to the collet adapter 17 is limited by shear pins 20.

The slip assembly comprises an anchor ring 3 which is affixed to the mandrel and connected to a lock housing 4 and lock 5 by shear pins 20*a*. The lock housing 4 is the uppermost element of the chain of activation elements. The lock 5 is defined by an inner surface of outer moveable piston 6, which is affixed to upper cone 8. The lock 5 comprises ratchet teeth that engages a ridged portion 2*a* of the outer surface of the mandrel 2 when the lock 5 moves during activation of the slips, as seen in FIG. 2F. Once the lock 5 engages the mandrel 2*a*, the outer moveable piston 6 is locked into its lower slip actuating position, even after fluid pressure is bled down to zero.

Slips 11 are retained within a slip cage 9 and are actuated by movement of the upper cone 8 while restrained against a lower cone 15. The outer piston 6 and a stationary ring 7 cooperate to form sealed activation chamber C together with the mandrel 2. The activation chamber C is open to the internal volume of the anchor through ports 24. Suitable O-ring seals 22, 23 ensure the activation chamber C is pressure sealed.

The slips 11 are extended by hydraulic pressure within the mandrel 2 which causes fluid to enter and expand the activation chamber C by displacing the outer piston 6 downwards. Sufficient pressure is required to shear pins 20*a* which connect the lock housing 4 to the anchor ring 3. Expansion of the activation chamber C causes the activation elements comprising lock housing 4 and outer piston 6 to move downwards relative to the mandrel. The outer moveable piston 6 is fixed to the upper cone 8, thereby activating the slips 11 between the upper cone 8 and the lower cone 15 in a conventional manner. Maximum stroke of the outer piston 6 is defined by the distance between the stationary ring 7 which is affixed to the mandrel 2, and the lock 5. The lock 5 becomes fixed in position on the mandrel due to the ratchet engagement between the two. The anchor in full slip extension is shown in FIG. 2E, where activation chamber C is shown in full expansion.

In some embodiments, the releasable anchor 200 is installed with a thermal liner top packer 100, and a profile packer assembly, which comprises a lock assembly 30, a profile sub 40 and a trip sub assembly 50. The profile sub 40 is threaded to the lower end of the releasable anchor 200 bottom housing 16. A liner 70 is attached to a lower pin end of the profile sub 40.

The profile packer assembly PP together with the shifting tool 60 may make up a single trip system. The lock assembly 30 is disposed inside the profile sub 40 with the upper body of the lock assembly 30 is placed within the anchor 200 mandrel 2.

In one aspect, disclosed is a method of installing a liner 70 in a wellbore having an intermediate casing IC, with a completion assembly comprising a liner connected below a liner top packer 100 and a releasable anchor 200, wherein a profile packer assembly PP is positioned within the releasable anchor, comprising the steps of:

(a) positioning the liner top packer 100 at a lower end of the intermediate casing IC;

(b) landing a ball in the profile packer assembly PP and pressuring up the wellbore to activate the releasable anchor 200 to engage the intermediate casing IC and to activate the packer 100 to seal against the intermediate casing;

(c) retrieving the profile packer assembly PP; and (d) releasing the releasable anchor 100 with a shift tool 60, leaving the liner connected to the liner top packer in an energized, pressure-competent state isolating the wellbore below the liner top packer.

Figure 3A:
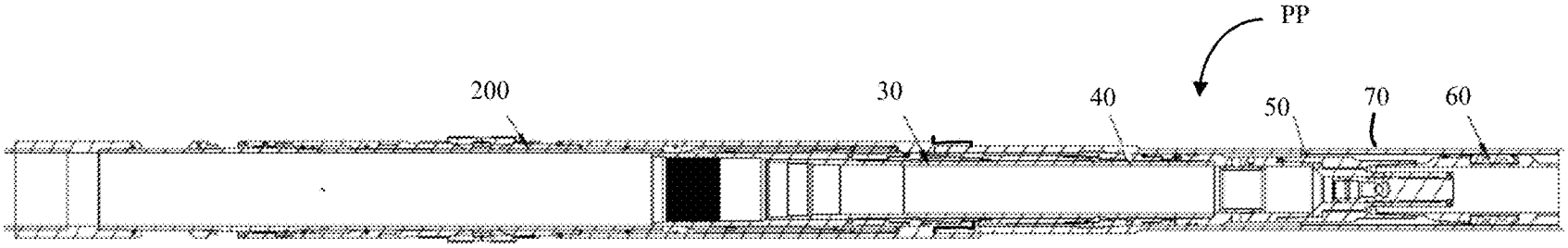
FIG. 3A is a cross-sectional view of the embodiment of FIG. 2A with the anchor set and installed profile sub, trip sub and shift tool.

Once the completion assembly is installed, a ball is dropped into the tubing string and lands in the blanked off trip sub 50. The releasable anchor may then be pressured up to shear the shear pins 20*a*, and activate the slips 11, as shown in FIG. 3A. The thermal liner top packer 100 is also hydraulically actuated at the same time to engage the casing IC and provide isolation of the annular space from below the packer 100.

In some embodiments, the profile packer assembly 30, 40, 50 may be retrieved and the releasable anchor 200 released in two trips. In a first trip, the profile packer assembly is retrieved with a retrieval tool as is well known in the art. Then, the releasable anchor 200 may be released by releasing the anchor slips 11 by shifting the mandrel 2 and upper cone 8 relative to the bottom housing 6 and the lower cone 15, as shown in FIG. 2F. The shift tool 60, which may be a conventional shift tool, such as a Otis style shifting tool may be inserted to engage the shift ring 18 and move it upwards relative to the collet fingers 17*a*. As a result, the collet fingers 17*a* are free to collapse inwards and disengage the bottom housing 16. The bottom housing and the lower cone 15 may then move downwards on the mandrel 2, releasing the slips 11. The liner top packer 100 remains actuated in a pressure-competent state to provide isolation of the annular space below the packer.

Figure 3B:
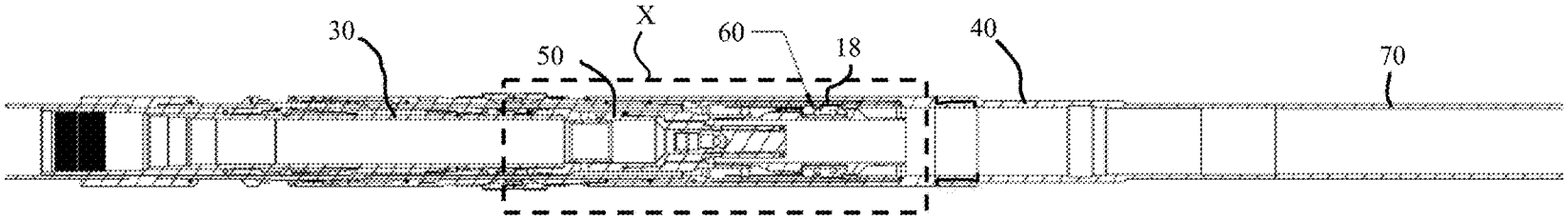
FIG. 3B shows the same view with the profile packer partially retrieved, and the shift tool engaged with the releasable anchor shift ring.
Figure 3C:
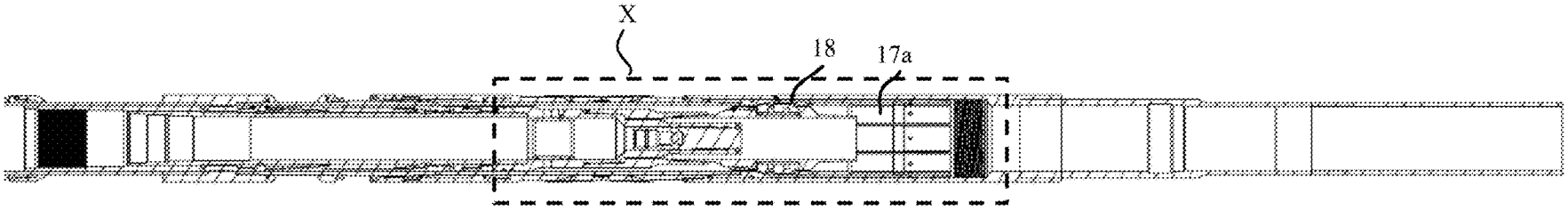
FIG. 3C shows the same view after the anchor has shifted and anchor slips retracted.
Figure 4A:
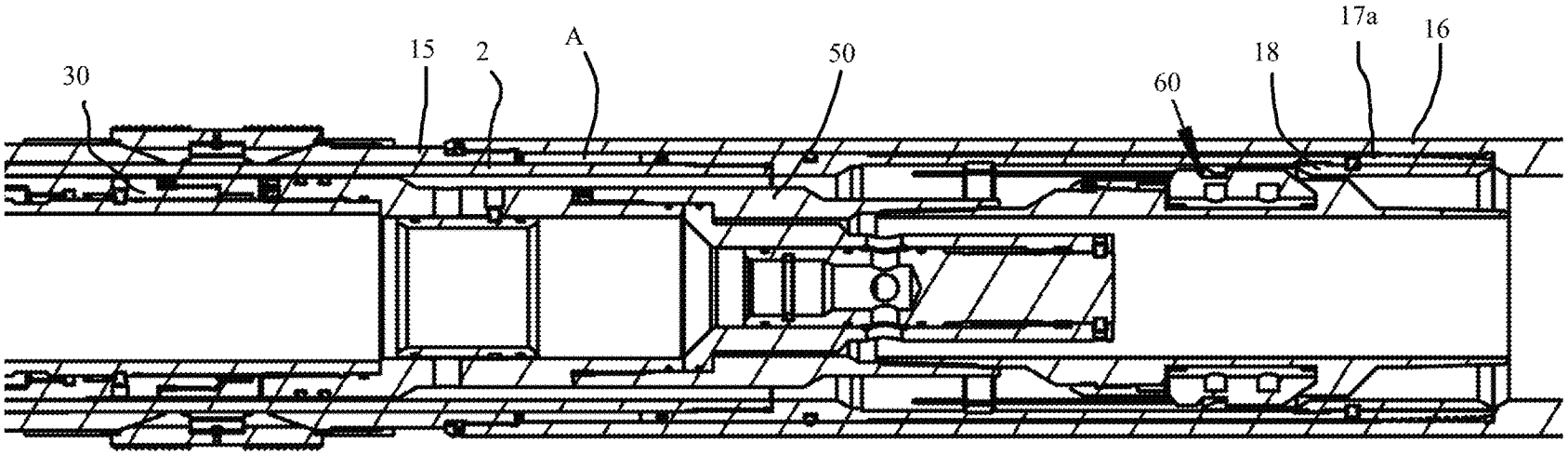
FIG. 4A is a detailed view of the portion labelled "X" in FIG. 3B.
Figure 4B:
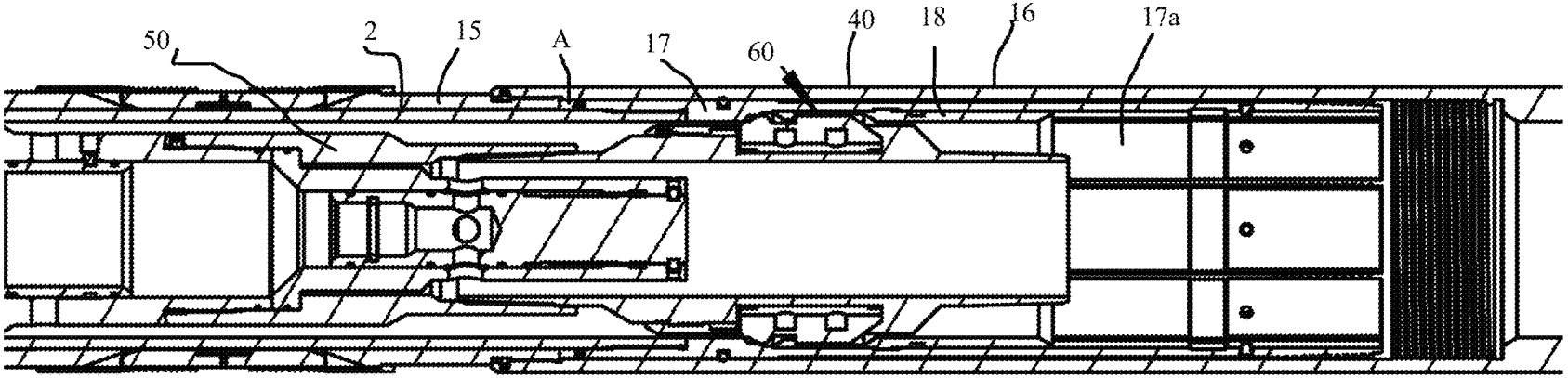
FIG. 4B is a detailed view of the portion labelled "X" in FIG. 3C.

In some embodiments, the profile packer assembly may be retrieved and the releasable anchor 200 released in a single trip. The shift tool 60 is positioned on the downhole end of the trip sub 50. When the packer lock assembly, profile sub and trip sub are retrieved, the shift tool 60 is pulled upward through the releasable anchor 200, as may be seen in FIG. 3B and in FIG. 4A. The shift tool 70 may then engage the shift ring 18 and pulling upwards releases the slip assembly in like manner as described above, as may be seen in FIG. 3C and FIG. 4B. Thus, the profile packer may be retrieved and the anchor 200 released in one operation.

In some embodiments, the shift tool may comprise an internal pocket in which the shift dogs (not shown) may be retracted into.

Once the anchor 200 is released, the production liner may experience thermal expansion, resulting in sliding movement of the liner top packer 100 within the casing IC. The packer 100 may move within the casing IC while maintaining a seal isolating the annulus from the wellbore below.

Interpretation.

The forgoing description supplies specific details in order to provide a thorough understanding. Nevertheless, the skilled artisan would understand that the apparatuses, systems, and associated methods of using the apparatuses and systems can be implemented and used without employing these specific details. Indeed, the apparatuses, systems, and associated methods can be placed into practice by modifying the illustrated apparatus and associated methods and can be used in conjunction with any other apparatus and techniques conventionally used in the industry.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element, or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition, or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A method of installing a liner in a wellbore having an intermediate casing, with a completion assembly comprising a liner connected below a liner top packer and a releasable anchor, wherein a profile packer assembly is positioned within the releasable anchor, and the releasable anchor comprises: a cylindrical mandrel defining an inner volume; a top sub attached to an upper end of the mandrel, the top sub comprising a connection for coupling the liner top packer; an anchor ring fixed to an outer surface of the mandrel and an upper cone slidably moveable between a running position and an activated position, wherein activation elements are disposed between the anchor ring and the upper cone, defining a sealed activation chamber between the activation elements and the mandrel, which activation chamber is in fluid communication to the mandrel inner volume through at least one port, wherein expansion of the activation chamber causes the activation elements and the upper cone to move to their activated position; a lower cone fixed to the mandrel and a bottom housing fixed to a lower end of the lower cone by at least one shear pin, wherein the bottom housing is couplable to the profile packer; a slip assembly comprising slips actuatable between the upper cone and the lower cone; a collet adapter affixed to a lower end of the mandrel and disposed within the bottom housing, the collet adapter having downwardly extending collet fingers; and a shift ring slidably moveable within the collet adapter between a non-released position where the shift ring retains the collet fingers against an inner surface of the bottom housing, preventing longitudinal movement of the bottom housing relative to the mandrel, and a released position where the collet fingers may collapse to disengage the bottom housing, permitting longitudinal movement of the bottom housing relative to the mandrel;

and wherein the method comprises the steps of:

(a) positioning the liner top packer at a lower end of the intermediate casing;

(b) landing a ball in the profile packer assembly and pressuring up the wellbore to activate the releasable anchor to engage the intermediate casing and to activate the packer to seal against the intermediate casing;

(c) retrieving the profile packer assembly; and (d) releasing the releasable anchor with a shift tool, leaving the liner connected to the liner top packer in an energized, pressure-competent state isolating the wellbore below the liner top packer.

2. The method of claim 1, wherein the completion assembly comprises a shift tool, and the profile packer assembly is retrieved and the releasable anchor released in a single trip.

* * * * *